United States Patent [19]

Hedegaard

[11] 4,098,208

[45] Jul. 4, 1978

[54] SEWING MACHINE HAVING A DEVICE FOR INITIATING THE MOVEMENT OF THE THREAD CATCHER OF A THREAD CUTTING DEVICE

[75] Inventor: Kristen Hedegaard, Gentofte, Denmark

[73] Assignee: Pfaff Industriemaschinen GmbH, Fed. Rep. of Germany

[21] Appl. No.: 809,678

[22] Filed: Jun. 24, 1977

[30] Foreign Application Priority Data

Jul. 17, 1976 [DE] Fed. Rep. of Germany ..... 2632362

[51] Int. Cl.[2] ..... D05B 65/02

[52] U.S. Cl. ..... 112/291; 112/254; 112/300

[58] Field of Search ..... 112/291, 300, 292, 189, 112/191, 181, 184, 202, 296, 298

[56] References Cited

U.S. PATENT DOCUMENTS

| | | | |
|---|---|---|---|
| 3,054,365 | 9/1962 | Ioannilli | 112/291 X |
| 3,658,021 | 4/1972 | Hedegaard | 112/292 |
| 3,756,177 | 9/1973 | Landwehr | 112/292 X |
| 3,776,161 | 12/1973 | Papejewski et al. | 112/292 |

FOREIGN PATENT DOCUMENTS

| | | | |
|---|---|---|---|
| 1,485,265 | 11/1969 | Fed. Rep. of Germany | 112/291 |
| 1,125,742 | 3/1962 | Fed. Rep. of Germany | 112/291 |
| 1,159,247 | 12/1963 | Fed. Rep. of Germany | 112/291 |

*Primary Examiner*—H. Hampton Hunter

*Attorney, Agent, or Firm*—McGlew and Tuttle

[57] ABSTRACT

The sewing machine includes a reciprocating needle bar with a thread-engaging needle which cooperates with a rotatable looper carrying the looper thread which is driven by a rotatable looper drive shaft. The construction includes a thread knife and a thread clamp mounted adjacent the looper and a catcher mounted on a catcher shaft for rotation therewith selectively in the same direction of movement as the looper toward engagement with the knife and in an opposite return direction. The construction includes an improved control member for operating the catcher which is freely rotatable on the looper shaft and is axially displaceable therealong between an operative position and an inoperative position spaced axially from the operative position. A coupler is provided between the control member and the looper shaft which includes a driver having a rod portion which extends in a groove of the control member. A biasing spring biases the control member into an operative position. A stud abutment is mounted to move toward and away from a control member between a starting and an operative position and may be locked in the starting position. The stud abutment is engageable with a cam portion of the control member and the cam portion acts to return the stud abutment to a starting position. A retaining member is located adjacent the control member and it is mounted so that it can be biased by a spring associated therewith to hold the control member in an operative position.

5 Claims, 4 Drawing Figures

SEWING MACHINE HAVING A DEVICE FOR INITIATING THE MOVEMENT OF THE THREAD CATCHER OF A THREAD CUTTING DEVICE

FIELD AND BACKGROUND OF THE INVENTION

This invention relates in general to sewing machines and, in particular, to a new and useful device for initiating the movement of the thread catcher of a thread cutting device whose actuating linkage comprises a sensing lever adapted to be coupled with a control disc drivable synchronously with the looper shaft of the sewing machine.

A thread cutting device for sewing machines is known from German Pat. No. 1,125,742, wherein the movement of the thread catcher is initiated by means of a hand lever which may be actuated only during standstill of the machine, via a shift linkage. A locking lever cooperating with a cam plate is pivoted in a certain position of the cam plate to release the pawl of an entrainer disc. The pawl is secured on an intermediate shaft connected with the looper drive shift, so that the pawl comes into operative position, in which it comes into engagement with a driver pin secured on a gear loosely mounted on the intermediate shaft and connected with the looper drive shaft via a gear pair. Via the pin and the pawl, as the rotation of the machine continues, the entrainer disc is driven by the intermediate shaft, from which via a crank, a coupling and a disc loosely mounted on the looper drive shaft, the movement required for thread cutting is imparted to the thread catcher. A cam plate provides for the control of the locking lever to bring the pawl into its inoperative position outside the movement path of the pawl at the end of the cutting process.

Since this cutting device can be operated for thread cutting only at standstill of the machine, it has been proposed by German Pat. No. 1,159,247, to provide a shifting shaft parallel to the looper drive shaft, consisting of two sections connected by a compensating clutch, with one section being non-displaceable axially, while the other section is axially movable. The axially non-displaceable section is connected with the thread cutting device, while the other section can be brought into operative connection with a control disc secured on the looper shaft. A compression spring is disposed on this section which takes support at one end against a stop secured on it and at the other end against an axially displaceable bushing disposed on this section for axial displacement and which applies against a hand- or foot-operated shifting fork. An abutment ring is arranged on the axially movable section, the end face of which cooperates with a locking lever in a drive connection with the looper drive shaft via a friction clutch. The locking lever applies against the axially movable section next to the end face of the abutment ring due to the torque acting on it via the friction clutch when the machine is running. If the bushing is axially displaced by the shifting fork and the compression spring is thus tensioned, to initiate the thread cutting process while the machine is running, the locking device will prevent a displacement of the axially movable section. The switch-on pulse, is therefore stored.

After the machine has been stopped, the looper drive shaft rotates back a small amount counter to its operative direction of rotation as a result of the return energy stored in the elastic drive belt of the machine. The locking lever is lifted and releases the abutment ring and hence the switch-on pulse. The axially movable shifting shaft section is suddenly displaced by the slackening compression spring so that a lag pin, fastened to a crank of the section, penetrates into the cam groove of the control disc. As rotation of the machine continues, according to the form of the cam groove, a pivotal movement is transmitted by the crank to the axially movable shifting shaft section and conveyed on via the compensating clutch to the axially non-displaceable section which, via a crank and a coupling, imparts to the thread catcher the movement required for seizing and severing the thread. In this device, the shift fork must be held in its operative position for the duration of the cutting process since, if inadvertently let go, the cutting process would be interrupted prematurely. Thus, some uncertainty exists with respect to the completion of the cutting process.

It can be seen that both devices require considerable cost of engineering for the initiation and control of the thread cutting device. Also unsatisfactory is the fact that the coupling of the gear parts of the thread catcher with the control or entrainer disc causes a percussion noise and the parts are under severe stress by the sudden impact.

The simplification of such devices has been attempted by using an electromagnet as a drive means for the thread catcher (German Pat. No. 1,485,265). Here, the operative movement of the thread catcher proceeds in a sudden stroke of the magnet all the way counter to the action of a return spring, and thus occurs during standstill of the machine in a certain position of the needle in which the threads occupy the correct position for being seized by the thread catcher. However, it is relatively difficult to provide for the exact control of this position, and there is great danger that the position of the threads will vary due to their inherent elasticity after stoppage of the machine, so that the thread catcher does not seize the threads or does not correctly engage the threads.

SUMMARY OF THE INVENTION

The present invention produces a device for initiating the movement of the thread catcher of a thread cutting device to establish a coupling connection between an actuating linkage of the thread catcher and a control disc, both gently and joltlessly and insures that the coupling connection cannot be undone before the thread cutting process is completed.

In accordance with the invention, the control disc is arranged axially displaceable on the looper drive shaft between an inoperative and an operative position and is non-rotationally connected with the shaft. An abutment which is displaceable into the movement path of a cam section of the control disc operative parallel to the longitudinal axis of the looper drive shaft, is provided, which abutment can be returned by a cam of the control disc to its starting position and can be locked there. A retaining member is associated with the control disc for temporary support in its operative position against the restoring action of a spring.

To initiate the cutting process, it is sufficient with this device to undo the locking of the supporting stud. The supporting stud forms an abutment for the control disc in its operative position, which, through its cam section, cooperating with the supporting stud, is axially displaced into the operative position in which its curved faces control the movement of the thread catcher and are in the zone of the sensing lever of the actuating linkage for the thread catcher. The coupling connection with the actuating linkage is thus established in a joltless and quiet manner.

During the displacement of the control disc into its operative position, the supporting stud is pushed out into its starting position by the cam on the control disc and is locked there as soon as the control disc has reached its operative position. The retaining member then holds the control disc in this operative position counter to the action of a return spring. It is thereby assured that the thread cutting process continues to its end and inadvertent premature interruption is ruled out.

In a device according to he embodiment of the invention, having a linkage for the release of the needle thread tension in addition, there results a particularly simple construction due to the fact that the retaining member is arranged on the normally required linkage for the release of the needle thread tension, and the control disc is provided with an axially active butting face for the retaining member which changes over to a slopeless section and terminates in a recess directed parallel to the longitudinal axis of the looper drive shaft and permits the return of the control disc to its starting position.

The use of a control disc with a curved surface at the periphery instead of a control disc with a curved groove on the end face is advantageous because of its simpler and less expensive production cost. When using such a control disc, the contact between the control surface and sensing lever is normally maintained by a relatively strong spring. With the pressurization of the sensing lever, however, the force of the spring must be overcome, causing the machine to run rather heavily. This is remedied in a simple manner in that the sensing lever is forked and its two lever arms come into engagement successively with the cam sections provided on the peripheral surface of the control disc for execution of the operative and return movements of the thread catcher.

With this design, it is possible to arrange the sensing lever and the actuating linkage of the thread catcher for very easy motion. All that is necessary is to see to it that the sensing lever and actuating linkage do not move by themselves due to the vibration of the running machine. This can be effected, for example, by a brake spring.

A simple drive connection for the control disc is obtained by securing a driver on the looper drive shaft carrying the control disc which is connected with the control disc. Also, the driver is provided with a control surface for bringing the sensing lever back to its starting position. It is thereby assured that the sensing lever, which in the cutting process is brought back to its starting position by a cam section of the control disc, will be brought to its starting position by the control surface of the driver with the first revolution of the looper drive shaft, even after repairs or adjustments on the machine, during which it may inadvertently have been moved out of its starting position, which is the only position in which establishment of the coupling connection between the control disc and the sensing lever is possible. In any other position, the control disc and sensing lever would collide when switching on the thread cutting device, and this could lead to damage to these parts and to breakage of the drive members of the machine.

Accordingly, an object of the invention is to provide a device for initiating the movement of a thread catcher of a thread cutting device whose actuating linkage comprises a sensing lever adapted to be coupled with a control disc movable synchronously with a looper shaft and wherein the control disc is arranged axially displaceable on the looper device shaft between an inoperative and an operative position and is non-rotatably connected with the looper drive shaft by a coupling and which further includes an abutment or stud member displaceable into the movement path of the cam section of the control disc which is operative parallel to the longitudinal axis of the looper drive shaft and which can be brought back into its starting position by a cam of the control disc and locked in a position and including a retaining member associated with the control disc for temporarily supporting it in its operative position against the restoring action of an associated spring which biases it to an inoperative position.

A further object of the invention is provide a sewing machine device for initiating the movement of a thread catcher of a thread-cutting apparatus which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawing and descriptive matter in this there is illustrated a preferred embodiment of the invention.

DESCRIPTION OF THE PREFERRED EMBODIMENT

Figure 1:
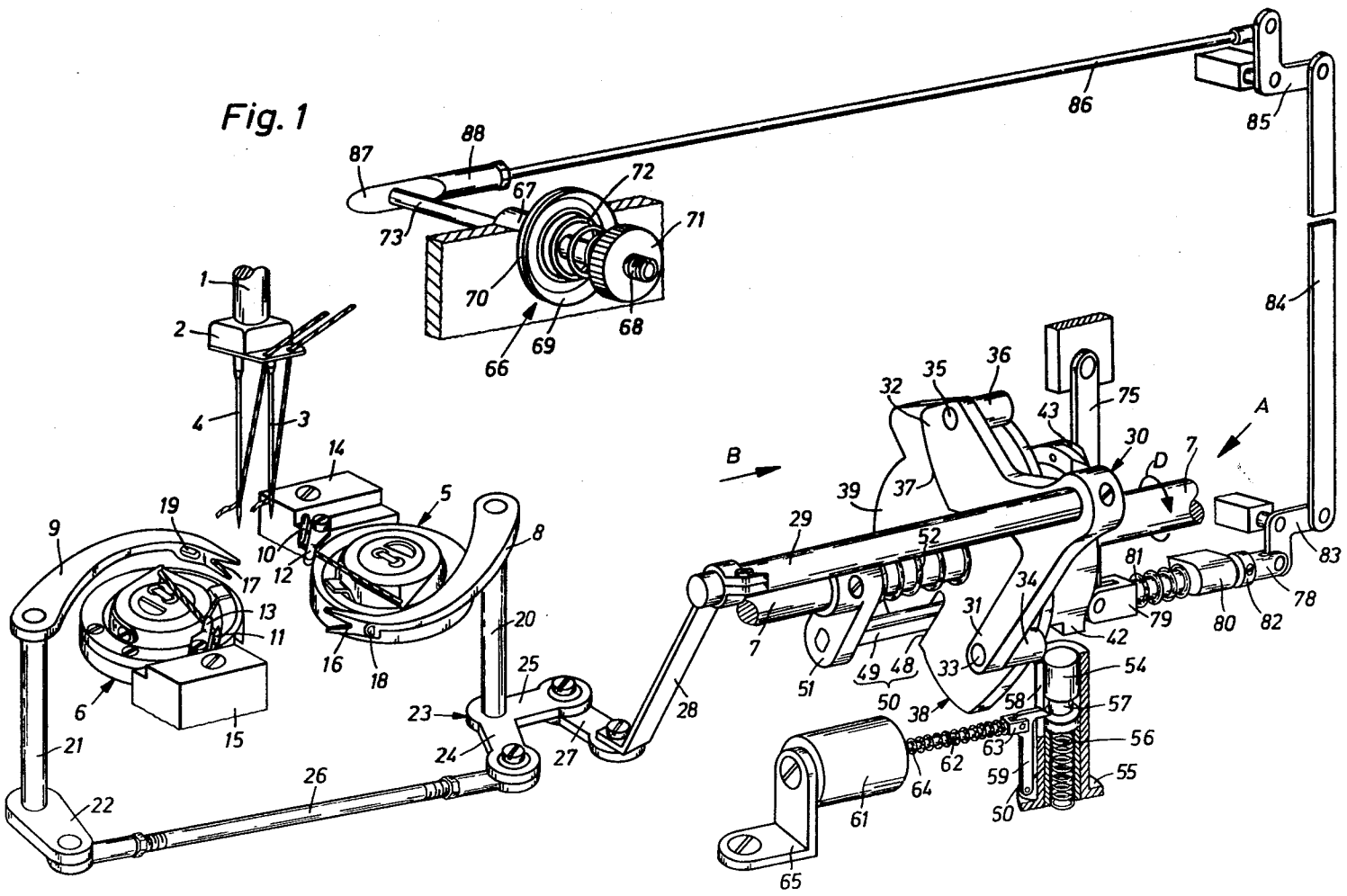
FIG. 1 is a simplified perspective view of a two-needle sewing machine having a device for initiating a movement of a thread catcher of a thread catching device constructed in accordance with the invention.
Figure 2:
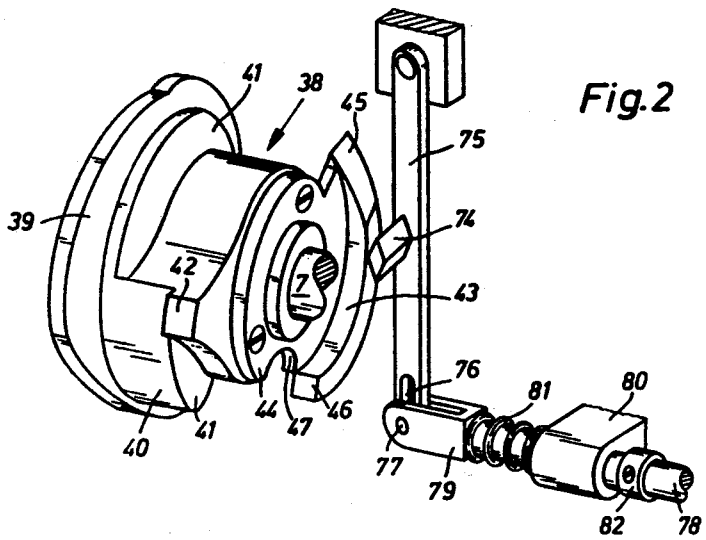
FIG. 2 is a perspective view of the control disc and a part of the linkage for release of the thread tension, viewed approximately in the direction of the arrow A of FIG. 1.
Figure 4:
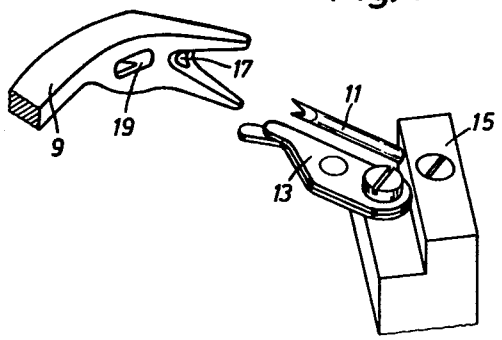
FIG. 4 is an exploded perspective view of the details of the thread catcher, of a counter-knife, and of a bottom thread clamp on a larger scale from that indicated in FIG. 1.

Referring to the drawings in particular, the invention embodied therein, comprises a device for initiating the movement of a thread catcher of a thread cutting device which is shown on a conventional two-needle flat looper sewing machine, which has a needle holder 2 with two thread guiding needles 3 and 4 attached to its up and down moving needle bar 1. Loopers 5 and 6, driven in a known manner by the looper drive shaft 7, cooperate with the needles 3 and 4 and take up a bottom thread bobbin, for the formation of two independent lock stitch seams (stitch type 301). The sewing machine is driven by a known on-off motor and can be stopped by a needle-positioning device in selected positions, e.g., in needle "down" before initiation of the thread cutting operation and in thread lever "up" position after the thread has been cut.

To seize and cut off the needle and looper threads, two movable thread catchers 8 and 9 cooperate with respective ones of two fixed counter-knives 10 and 11.

The knives 10 and 11 are secured on a respective looper bearing block 14 and 15, as are also bottom thread clamps 12 and 13 consisting of two small spring plates. The thread catchers 8 and 9 are forked at their front end and comprise, between the fork legs, a bore 16 and 17 for the respective counter-knife 10 and 11, and spaced therefrom, a cutout 18 and 19 for the bottom thread clamps 12 and 13. The thread catcher 8 is secured on the upper end of a vertical shaft 20 and the thread catcher 9 is secured on the upper end of a vertical shaft 21. The shafts 20 and 21 are mounted in respective looper bearing blocks 14 and 15. A crank 22 is fastened at the lower end of shaft 21, and an angle lever 23 with the lever arms 24 and 25 is fastened at the lower end of shaft 20. The crank 22 and the lever arm 24 of the angle lever 23 are connected by a ball pull rod 26. A ball link 27 engages at the lever arm 25 of the angle lever 23 which is connected with a clamping lever 28 secured on an intermediate shaft 29 mounted in the work-carrying plate of the sewing machine. A forked sensing lever 30 is secured on the shaft 29, and it comprises lever arms 31 and 32. A roll stud 33 with a roll 34 is secured at the free end of the lever arm 31 and a roll stud 35 with a roll 36 * is secured at the free end of the lever arm 32. In addition, lever arm 32 is provided with a butting face 37.

Figure 3:
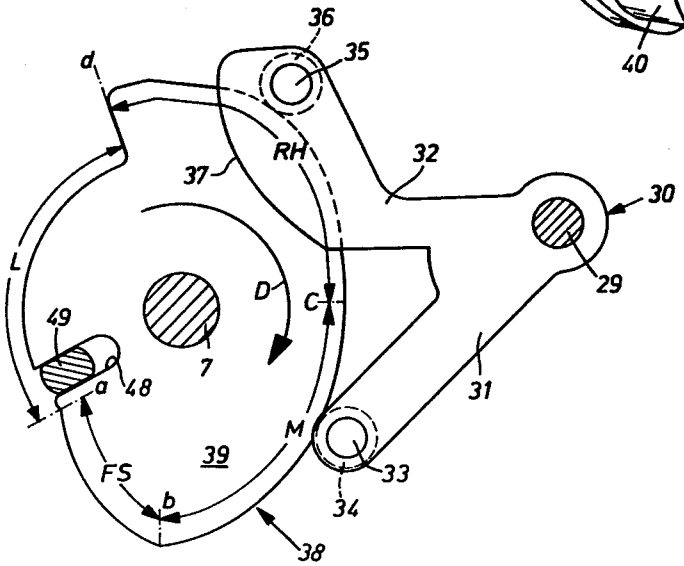
FIG. 3 is a front elevational view of the part of the control disc cooperating with the sensing lever, viewed in the direction of arrow B of FIG. 1.

For control of the movements of the sensing lever 30 and hence of the movements of the thread catchers 8 and 9, as well as of the actuating linkage for the thread tension device to be described later, a control member 38 is loosely mounted on the looper shaft 7. The control member 38 includes a curved surface at the periphery of a curved profile disc 39 with cam sections FS, RH, L and M, as shown in FIG. 3. The control member 38 also includes a cam plate 40, whose curved path 41 on the end face ascends in spiral form, and a radially active cam 42, as well as a plate 44, fitted with a segment 43 and having a butting face 45 on the face which, in the initial region, has an axially active slope and then changes over to a slopeless section. The curved profile disc 39 and the segment plate 44 are screwed to cam plate 40. Segment 43 ends with a surface 46 in a recess 47 of plate 44, which extends parallel to shaft 7. The control member 38 is non-rotationally connected with the looper drive shaft 7 by a compensating clutch 50 formed by a driver stud 49 guided in a groove 48 of the control disc 38. The driver stud 49 is secured in a driver 51 secured on the looper driver shaft 7. The outer circular peripheral face of the driver stud 49 serves as a control surface for the return of the sensing lever 30, on whose butting face 37, the driver stud 49 butts. The control disc 38 is axially displaceable counter to the action of a return spring 52 which is disposed on the looper drive shaft 7 between the driver 51 and the control disc 38.

A stud 54 which is displaceably received in a fixed sleeve 55 is associated with cam plate 40 as an abutment. The stud 54 is partially drilled open for the uptake of a compression spring 56 and, in addition, it comprises a peripheral groove 57 for locking in its inoperative position, into which a pawl 59 extending into sleeve 55 through a slit 58 engages by its front end. Pawl 59 is pivotable in a bearing shoulder 60 and is connected with a forked head 63 secured on the pull rod 62 which is connected with the armature of an electromagnet 61. The pull rod 62 is axially displaceable by the magnet 61, counter to the action of a return spring 64. The electromagnet 61 is secured on a holding bracket 65 which is fast to the work carrying plate of the sewing machine.

Before the threads are cut, they must be pulled out to a length sufficient for the next following stitch formation. This is effected expediently with the needle thread tension released. In the drawing, for the sake of clarity, only one thread tension device 66 is shown in FIG. 1, but a tension device is provided for each of the two needle threads. The tension device 66 consists of a sleeve 67 secured in the machine housing having a longitudinally slotted bolt 68 on which are arranged two tension discs 69 and 70 which are compressed by a tension spring 72 adjustable by means of a knurled nut 71 to exert a braking force on the needle thread. A releasing pin 73 is longitudinally displaceable in sleeve 67 by which tension disc 69 can be lifted off tension disc 70, counter to the action of the tension spring 72, to release the thread tension.

To actuate the releasing pin 73 and hence to release the thread tension there serves the butting face 45 of a segment 43 disposed on the segment plate 44 of control disc 38. A shoulder 74 of lozenge-shaped cross-section, which also serves as a retention member for the control disc 38, cooperates with the butting face 45. Shoulder 74 is provided on a lever 75 mounted on the machine housing. The lower end of lever 75 is pivoted by means of a pin 77 passed through a slot 76 with the forked head 79 secured on a sliding rod 78. The sliding rod 78 is received for axial displacement in a bearing shoulder 80 of the machine housing. A return spring 81 is provided between the forked head 79 and the bearing shoulder 80. On the sliding rod 78, to limit the return movement, a setting ring 82 is secured, which cooperates with the bearing shoulder 80. The other end of the sliding rod 78 is connected with an angle lever 83 mounted on the machine housing and connected by a coupling or link 84 with another angle lever 85 mounted on the machine housing. A push rod 86 is articulated to the angle lever 85, which carries a release element 88 at its front end, which is provided with a slant or bevelled surface 87.

Assuming that the sewing machine is running, the control disc 38 non-rotationally connected with the looper drive shaft 7 by the compensating clutch 50 co-rotating in its axial inoperative position, in which the curved surface (L, M, FS, RH) of the profile disc 39 is outside the zone of the sensing rolls 34 and 36, the thread catchers 8 and 9, with their actuating linkage occupying their starting position secured by a brake spring, not shown, the thread tension device 66 being closed and the stud 54 serving as an abutment for the control disc 38 being locked in its inoperative position by the pawl 59, the device operates as follows:

At the end of the seam, the sewing machine is stopped briefly by a known needle positioning device in the needle "down" position as the starting position for thread cutting. The curved profile disc 39 then occupies a position in which the sensing roll 34 of the sensing lever 30 is opposite the starting zone of cam section L. By actuation of a switch, preferably by back-pedaling, the electromagnet 61 is briefly switched on and immediately thereafter, the drive motor of the machine is also switched on. The pawl 59 is pulled back by the pull rod 62 of the electromagnetic 61 and thus releases the stud 54, which is displaced by the relaxing compression spring 56 against the cam plate 40. During the next single rotation of the looper drive shaft 7, in the direction of arrow D, in FIG. 1 and 3, necessary for thread cutting, the control disc 38 takes support by the curved path 41 of the cam plate 40 against the stud 54 serving as an abutment, whereby, the control member 38 is displaced according to the slope of the curved path 41 from its inoperative position axially to the left into its operative position, referred to in FIG. 1. Thus, the curved surface of the profile disc 39 comes into the zone of the sensing rolls 34 and 36 of the sensing lever 30. This coupling occurs noiselessly and joltlessly while the cam section L, corresponding to an arc of circle, runs past the sensing roll 34. The coupling process is completed when the sensing roll 34 has reached point a of the profile disc 39.

As rotation continues, the sensing lever 30 is pivoted over the sensing roll 34 by the ascending cam section FS, and hence, also the intermediate shaft 29. This movement is transmitted via the clamping lever 28 and the ball link 27 to the angle lever 23 firmly connected with the swinging shaft 20 of the thread catcher 8, and via the coupling 26 to the crank 22 firmly connected with the swinging shaft 21 of the thread catcher 9. Here, the thread catchers 8 and 9 undergo a co-directional pivotal movement. The front forked end of each thread catcher 8 and 9 thus begins its rotary movement, which is at first co-directional with the loopers 5 and 6, after the loopers 5 and 6 have seized and widened the respective needle thread loop. Shortly before the dropping of the needle thread loops, the forked ends of the thread catchers seize both the needle thread and the looper thread, so that both come to lie in the intersection of the fork legs in front of the bores 16 and 17, respectively. The looper threads will then lie in front of the cutouts 18 and 19. As soon as the threads are seized in this manner, the needle thread tension device 66 is opened by the slanted butting face 45 of segment 43 via the retention member 74 provided on the lever 75 of the thread tension release linkage and via the actuating linkagen 78 and 79 and 83 to 88, in that, the release pin 73 is axially displaced by the slant 87 of the release element 88 and thereby the tension disc 69 is lifted off the tension disc 70 counter to the action of the tension spring 72.

The portion of the looper threads leading to the thread reserve is supplied during the rotary movement of the thread catchers 8 and 9 to the thread clamps 12 and 13 and is clamped therein. As the forward movement of the thread catchers 8 and 9 continues, the forked ends of the thread catchers 8 and 9 reach the counter-knives 10 and 11, so that both the needle and the looper threads are severed jointly by the counterknives 10 and 11 penetrating into the respective bores 16 and 17. The leg of the needle thread leading to the thread reserve is given a length sufficient to form the first stitch of the next sewing cycle, while the leg of the hopper thread leading to the thread reserve is held by the thread clamps 12 and 13 above the bobbin capsule, so that it will be sure to be seized upon formation of the next stitch. The threads are cut through when the sensing roll 34 is opposite point *b* of the profile disc 39.

When the control disc 38 has reached its operative position by the cooperation of stud 54 with the curved path 41 of cam plate 40, upon further rotation, the thread catchers 8 and 9 execute their described forward movement for the seizing and cutting of the threads and, via the retaining member 74, the linkage is actuated for the opening of the needle thread tension device 66, that is, when the slopeless section of the butting face 45 of segment 43 runs past the retaining member 74, stud 54 is pushed back by cam 42 into its starting position, in which it is locked by the dropping of pawl 59 into groove 57. The control member 38 is now held in its operative position by the retaining member 74 cooperating with the butting face 45 of segment 43, instead of by stud 54, until the entire cutting process is completed, that is, until the return movement of the thread catchers 8 and 9 is completed.

The bringing back to their starting position, of the thread catchers 8 and 9, is effective by the ascending cam section RH of the profile disc 39 which, via the sensing roll 36, brings back the sensing lever 30 and, hence, also through the actuating linkage, the thread catchers 8 and 9, to the starting position, while sensing roll 34 applies against the descending portion M of the profile disc 39. The starting position of the thread catchers 8 and 9 is reached when sensing roll 36 is in front of the pitch point marked *d* near the end of the cam section RH. At this time, the recess 47 of the segment plate 44 is opposite the retention member 54. This allows both the return spring 52 and the return spring 81 to relax. Control disc 38 is displaced axially into its inoperative position by spring 52 on the looper drive shaft, and the actuating linkage 74, 75, 78, 79 and 83 to 88 of the needle thread tension device 66 is brought by spring 81 into its starting position determined by the setting ring 82 in connection with the bearing shoulder 80, in which position, the needle thread tension device 66 is closed. The machine is then stopped in thread lever "up" position and is ready for the next sewing operation.

It also should be mentioned that while the machine is running, the outer circular peripheral surface of the driver stud 49 of the compensating clutch 50 is tangential to the curved path 37 of the sensing lever 30 in its inoperative position. This assures that the sensing lever 30 will be brought to the starting position again during the first revolution of the looper drive shaft 7. Thereby, the thread catchers 8 and 9 with their actuating linkage also occupy their starting position, for example, after inadvertent displacement during maintenance work, and are thus ready for the initiation of a thread cutting process.

Lastly, it should be pointed out that the control principle shown is suitable for thread cutting devices also, where the thread catchers are so designed and the counter-knives are so arranged that the threads are only seized during the forward movement of the thread catchers and are cut off upon their being brought back.

While a specific embodiment of the invention has been shown and described in detail to illustrate the application of the principles of the invention, it will be understood that the invention may be embodied otherwise without departing from such principles.

What is claimed is:

1. In a sewing machine including a reciprocating needle bar with a thread-engaging needle cooperating with a rotatable looper which carries looper thread and is driven by a rotatable looper drive shaft and including a thread knife and a thread clamp mounted alongside each other adjacent the looper and a thread-catcher mounted on a catcher shaft which is driven from the looper shaft to move the catcher in the same direction of movement as the looper to the knife and in an opposite return direction, the improvement comprising, a control member for operating said catcher freely rotatably on said looper shaft and being axially displaceable therealong between an inoperative position and an operative position spaced from said inoperative position, a coupling for coupling said control member to the looper shaft, said control member having a control disc portion defining a control surface and a cam portion, a stud abutment, means mounting said stud abutment for movement toward and away from the control member between a starting position of said stud abutment and an operative position, locking means for locking said stud abutment in a starting position, said cam portion being engageable with said abutment to return it to a starting position, spring means biasing said control member to an inoperative position, a retaining member adjacent said control member and means mounting said retaining member for movement against said control member to hold it in an operative position.

2. In a sewing machine, the improvement claimed in claim 1, including a thread-tensioning device including first and second disc members, a disc spring for biasing said spring members together, and a linkage connected from said retaining member to said spring means for relieving the tension on said first and second discs and to relieve the thread tension, said control member having an axially active butting face engageable with said retaining member, said butting face including a slopeless section and a recess directed parallel to the longitudinal axis of said looper drive shaft for accommodating said abutment member to permit to said control member to be moved back to its operative position.

3. In a sewing machine, the improvement claimed in claim 1, wherein said control member includes a sensing lever of fork-shaped configuration having first and second arm portions with first and second sensing rolls thereon engaged with said control member at respective circumferentially spaced locations thereon, said control member including a disc portion having cam sections provided on the peripheral surface engageable with said sensing members for the return movement of said thread catcher.

4. In a sewing machine, the improvement claimed in claim 3, wherein said coupling means includes a driver secured to said looper drive shaft, said sensing lever having a control surface engageable with said drive which acts on said sensing layer to return it to a starting position.

5. A sewing machine having a reciprocating needle, a rotatable bobbin arranged below said needle carrying looper thread for engagement with a thread carried by said needle, a thread clamp adjacent said looper, a knife alongside said clamp in a position to cut thread positioned in said clamp, a catcher engageable with the looper thread to hold it and to move it toward engagement with said knife, a thread catcher shaft carrying said catcher being rotatable by said looper shaft to move said catcher, a control shaft connected to said thread catcher shaft, a sensing member having first and second arm portions secured to said control shaft, a control member carried on said looper drive shaft and being axially displaceable therewith, means biasing said control member to an inoperative position, said sensing member having a sensing roll on each arm portion engageable with said control member at spaced circumferential locations thereon, an abutment member movable into engagement with said control member for anchoring it in an inoperative position, means for locking said control member in an engagement position, a lever pivotally mounted alongside said control member having a shoulder portion engageable with a butting face of said control member, a thread-tensioning device including first and second disc members between which the needle is engaged for tensioning and spring means for applying tension to said first and second disc members, a lever connected between said spring means and said lever being displaceable thereby to regulate the tension on said spring and to apply and remove tension to the thread and an operation spring acting on said lever to bias it against said control member to urge said control member into a non-operative position.

* * * * *